US006414567B2

(12) United States Patent
Matsumura et al.

(10) Patent No.: US 6,414,567 B2
(45) Date of Patent: Jul. 2, 2002

(54) DUPLEXER HAVING LAMINATED STRUCTURE

(75) Inventors: Sadayuki Matsumura, Takefu; Noboru Kato, Sabae; Hiroko Nomura, Nagaokakyo, all of (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/734,161

(22) Filed: Dec. 11, 2000

(30) Foreign Application Priority Data

Dec. 9, 1999 (JP) ..... 11-350771

(51) Int. Cl.[7] ..... H01P 1/213

(52) U.S. Cl. ..... 333/134; 333/185

(58) Field of Search ..... 333/134, 126, 333/204, 219, 185, 132

(56) References Cited

U.S. PATENT DOCUMENTS 5,029,043 A * 7/1991 Kitahara et al. ..... 361/321
5,719,539 A * 2/1998 Ishizaki et al. ..... 333/204
6,011,959 A * 1/2000 Reeser et al. ..... 455/76

FOREIGN PATENT DOCUMENTS

GB 2303495 A * 2/1997 ..... H01F/17/00
JP 6-85506 * 3/1994 ..... H01P/1/213

* cited by examiner

*Primary Examiner*—Robert Pascal
*Assistant Examiner*—Dean Takaoka
(74) *Attorney, Agent, or Firm*—Keating & Bennett, LLP

(57) ABSTRACT

A duplexer having a laminated structure includes a first three-stage band-pass filter having parallel LC resonators, and a second three-stage band-pass filter having parallel LC resonators. The first and second three-stage band-pass filters are coupled through impedance matching patterns. An inductor of each of the resonators is defined by via-holes formed on insulator sheets which are connected in sequence in the laminating direction of the sheets.

20 Claims, 3 Drawing Sheets

DUPLEXER HAVING LAMINATED STRUCTURE

BACKGROUND OF THE INVENTION

1. Field of the Invention

The present invention relates to a duplexer for use in communication systems such as microwave communication systems, and more particularly, to a duplexer having a laminated structure.

2. Description of the Related Art

A conventional laminated type duplexer is shown in FIGS. 4 and 5. Referring first to FIG. 4, a laminated duplexer 1 includes a laminated structure defined by ceramic sheets 2 to 9. Inductor patterns 12 to 17 are provided on a surface of the ceramic sheet 6. Frequency-adjusting capacitor patterns 18 to 23 are provided on a surface of the ceramic sheet 7. Coupling-adjusting capacitor patterns 24 to 27 are provided on a surface of the ceramic sheet 5. Shield patterns 28*a* and 29*a* are provided on a surface of the ceramic sheet 3, and shield patterns 28*b* and 29*b* are provided on a surface of the ceramic sheet 9.

The duplexer 1 includes a three-stage band-pass filter BPF1 having LC resonators Q1 to Q3 at the left as viewed in FIG. 4, and a three-stage band-pass filter BPF2 having LC resonators Q4 to Q6 at the right as viewed in FIG. 4. The inductor patterns 12 to 17 define inductors L1 to L6 of the LC resonators Q1 to Q6, respectively. The frequency-adjusting capacitor patterns 18 to 23 and the ends of the inductor patterns 12 to 17 which face the frequency-adjusting capacitor patterns 18 to 23 define capacitors Cl to C6 of the LC resonators Q1 to Q6, respectively.

The LC resonators Q1 to Q3 of the band-pass filter BPF1 are electrically connected to coupling capacitors Cs1 and Cs2 (not shown in FIGS. 4 and 5). The coupling and adjusting capacitors Cs1 and Cs2 are defined by the inductor patterns 12 to 14 and coupling-adjusting capacitor patterns 24 and 25, which face these inductor patterns 12 to 14. The shield patterns 28*a* and 28*b* are arranged such that the patterns 12 to 14, 18 to 20, 24 and 25 are positioned therebetween.

Likewise, the LC resonators Q4 to Q6 of the band-pass filter BPF2 are electrically connected to coupling capacitors Cs3 and Cs4 (not shown). The coupling capacitors Cs3 and Cs4 are defined by the inductor patterns 15 to 17 and coupling-adjusting capacitor patterns 26 and 27, which face the inductor patterns 15 to 17. The shield patterns 29*a* and 29*b* are arranged such that the patterns 15 to 17, 21 to 23, 26 and 27 are positioned therebetween.

The ceramic sheets 2 to 9 are laminated, and are integrally fired to define a laminate 35 shown in FIG. 5. The laminate 35 is provided with a transmitter terminal electrode Tx, a receiver terminal electrode Rx, an antenna terminal electrode ANT, and grounding terminal electrodes G1 to G4. The inductor pattern 12 of the LC resonator Q1 is connected to the transmitter terminal electrode Tx, and the inductor pattern 17 of the LC resonator Q6 is connected to the receiver terminal electrode Rx. The inductor patterns 14 and 15 of the LC resonators Q3 and Q4 are connected to the antenna terminal electrode ANT. The grounding terminal electrode G1 is connected to one end of each of the inductor patterns 12 to 14, and the grounding terminal electrode G2 is connected to one end of each of the frequency-adjusting capacitor patterns 18 to 20 in the LC resonators Q1 to Q3. The grounding terminal electrodes G1 and G2 are also connected with the shield patterns 28*a* and 28*b*. The grounding terminal electrode G3 is connected to one end of each of the inductor patterns 15 to 17, and the grounding terminal electrode G4 is connected to one end of each of the frequency-adjusting capacitor patterns 21 to 23 of the LC resonators Q4 to Q6. The grounding terminal electrodes G3 and G4 are also connected with the shield patterns 29*a* and 29*b*.

In general, duplexers have characteristics that depend upon the Q factor of inductors of LC resonators. The Q factor of an inductor is expressed by $Q=2\pi f_0 L/R$, where L represents the inductance of the inductor, R represents the resistance of the inductor, and $f_0$ represents the resonant frequency. From the equation, it is clear that the resistance R should be reduced to increase the Q factor of the inductor. The resistance R is inversely proportional to the cross-sectional area S of an inductor pattern that is used to define the inductor. To increase the Q factor of the inductor, therefore, the cross-sectional area S of the inductor patterns 12 to 17 must be increased.

However, increasing the thickness of the inductor patterns 12 to 17 to increase the cross-section S of the inductor patterns 12 to 17 produces undesirable results. Specifically, an internal strain of the laminate 35 is increased causing delamination when the ceramic sheets 2 to 9 are integrally fired. Furthermore, if pattern widths of the inductor patterns 12 to 17 are increased to increase the cross-section S of the inductor patterns 12 to 17, the LC resonators Q1 to Q6 is greatly increased.

The axial directions of the inductors L1 to L6 of the LC resonators Q1 to Q6 are perpendicular to the stacking direction of the ceramic sheets 2 to 9. When an electric current flows through the inductors L1 to L6, a magnetic flux $\phi$ is generated so as to surround the inductors L1 to L6 on planes perpendicular to the axial directions of the inductors L1 to L6. However, since the inductors L1 to L6 and the patterns 18 to 23, 24 to 27, 28*a*, 28*b*, 29*a* and 29*b* are arranged in parallel, the magnetic flux $\phi$passes through the patterns 18 to 23, 24 to 27, 28*a*, 28*b*, 29*a* and 29*b*, so that eddy currents are generated in the patterns 18 to 23, 24 to 27, 28*a*, 28*b*, 29*a* and 29*b*. This produces inductors L1 to L6 that have very low Q factors.

SUMMARY OF THE INVENTION

To overcome the above-described problems, preferred embodiments of the present invention provide a laminated-type duplexer which is compact and which has inductors with very high Q factors.

To this end, preferred embodiments of the present invention include a laminated type duplexer having insulator layers which are laminated to define a laminate including a plurality of filters embedded therein, each of the filters having an inductor and a capacitor, wherein each inductor includes a via hole or via-holes connected in sequence in the stacking direction of the insulator layers, and at least two adjacent filters of the plurality of filters are electrically connected to each other through a matching inductor pattern.

Since the inductor is defined by the via-holes connected in sequence, increasing the cross-section of each via-hole or increasing the number of via-holes results in increased cross-sectional area of the inductor. This improves the Q factor of the inductor without increasing the thickness or width of inductor patterns in conventional technique.

When an electric current flows through the inductor, magnetic flux is generated to surround the inductor on a plane that is substantially perpendicular to the axial direction of the inductor. However, since the inductor is substantially perpendicular to a capacitor pattern and a shield pattern, the generated magnetic flux does not pass through such patterns, so that no eddy current occurs in such patterns. This results in an inductor having a very high Q factor and reduced eddy current loss.

Other features, elements, characteristics and advantages of present invention will become apparent from the following detailed description of preferred embodiments thereof with reference to the attached drawings.

DETAILED DESCRIPTION OF PREFERRED EMBODIMENTS

A laminated type duplexer according to a preferred embodiment of the present invention is described with reference to the accompanying drawings.

Figure 1:
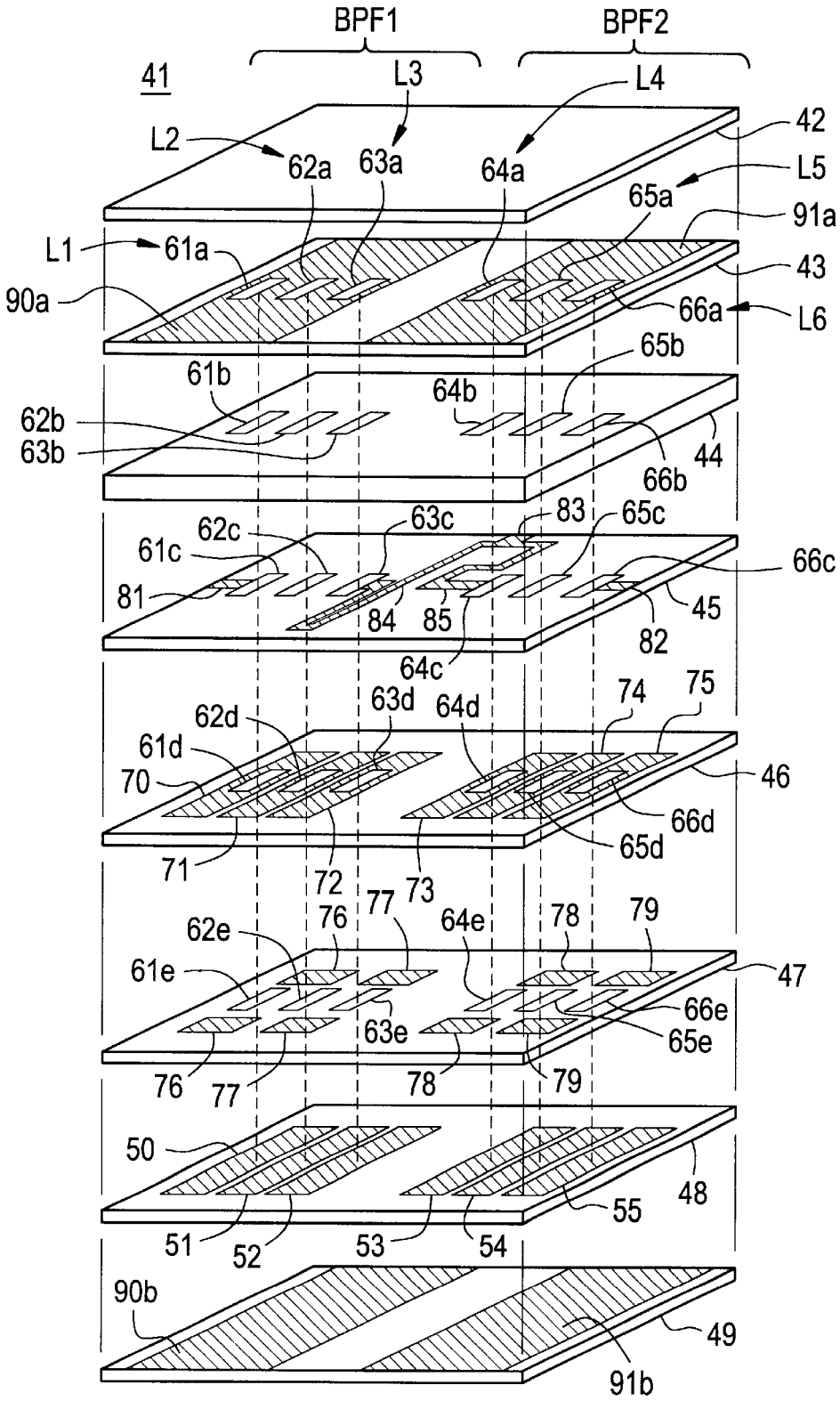
FIG. 1 is an exploded perspective view showing a laminated type duplexer according to a preferred embodiment of the present invention.
Figure 2:
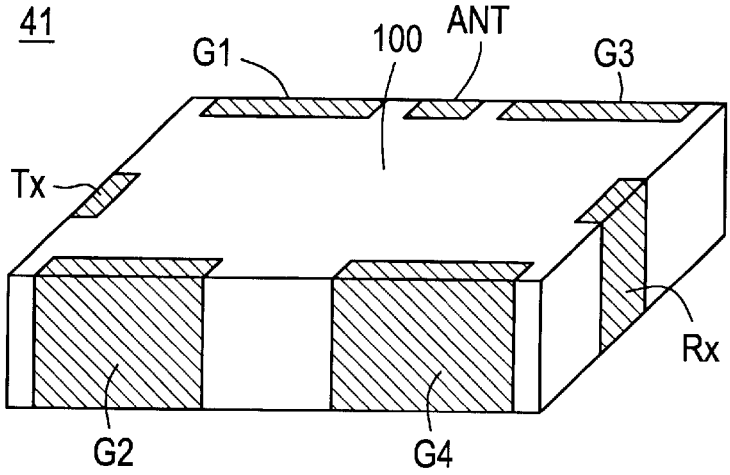
FIG. 2 is a perspective view of the external appearance of the laminated type duplexer shown in FIG. 1.
Figure 3:
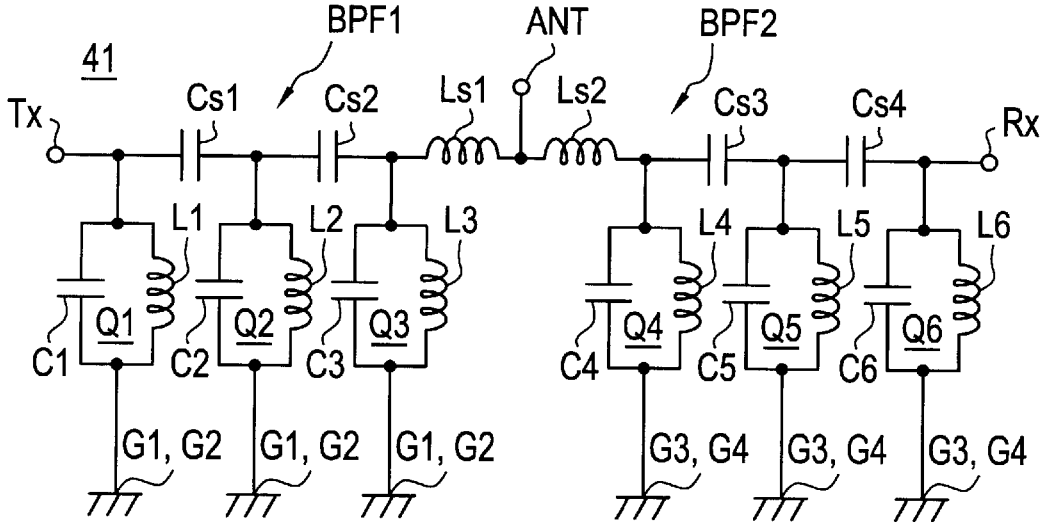
FIG. 3 is an equivalent circuit diagram of the laminated type duplexer shown in FIG. 2.
Figure 4:
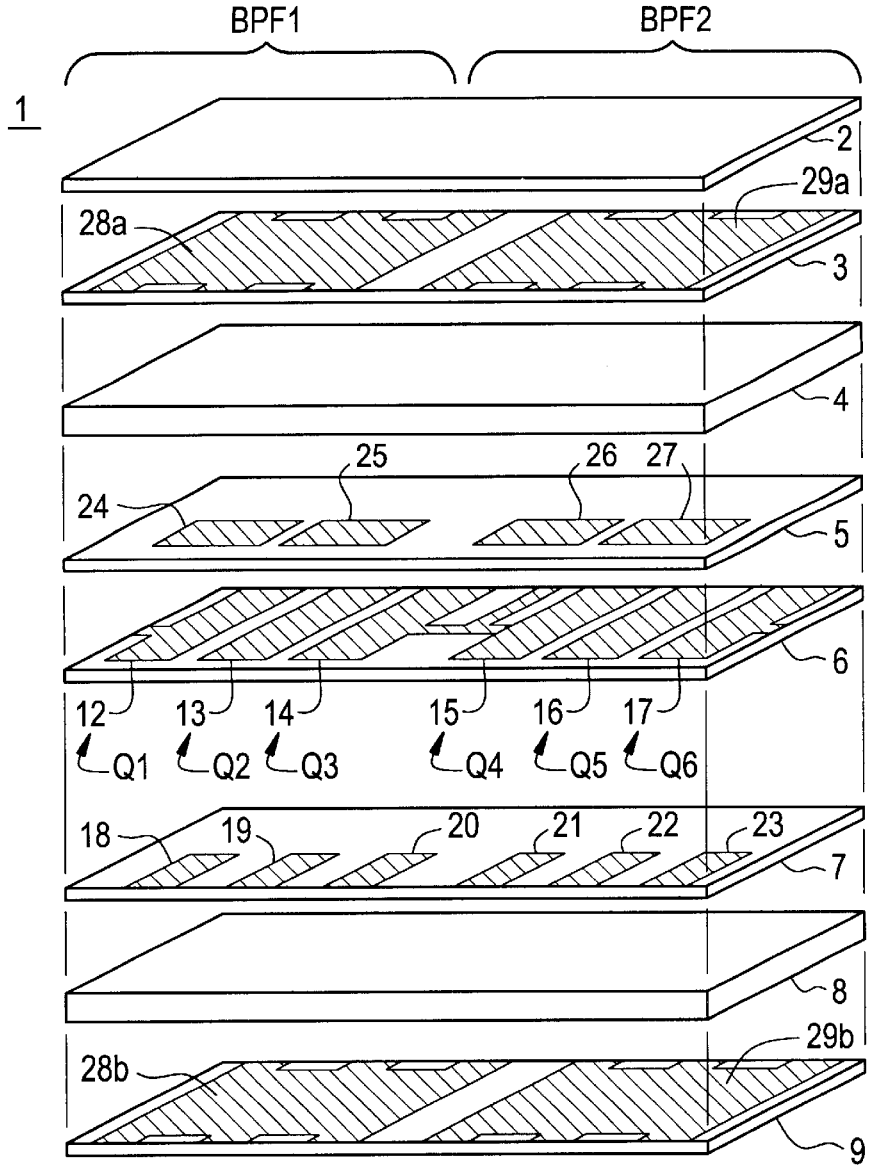
FIG. 4 is an exploded perspective view showing a conventional laminated type duplexer.
Figure 5:
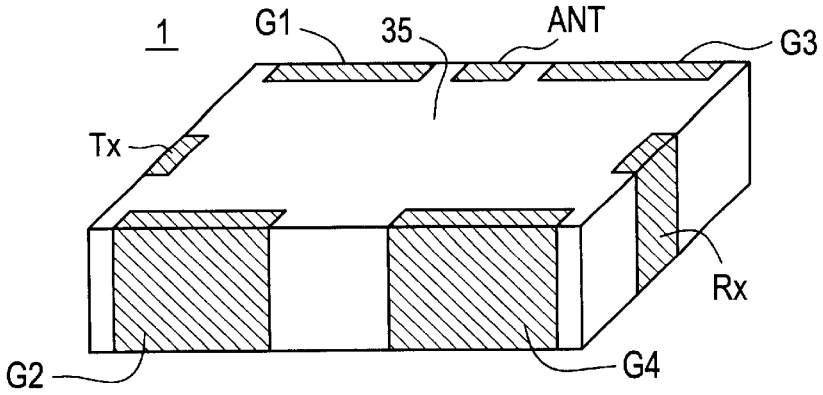
FIG. 5 is a perspective view of the external appearance of the laminated type duplexer shown in FIG. 4.

FIG. 1 shows a laminated type duplexer 41. FIG. 2 in perspective view of the external appearance of the duplexer 41. FIG. 3 is an equivalent circuit diagram of the duplexer 41. The duplexer 41 preferably includes a three-stage band-pass filter BPF1 having parallel LC resonators Q1 to Q3, and a three-stage band-pass filter BPF2 having parallel LC resonators Q4 to Q6, the band-pass filters BPF1 and BPF2 being connected through inductor patterns 84 and 85 arranged to achieve impedance matching.

Referring first to FIG. 1, the laminated type duplexer 41 is defined by insulator sheets 42 to 49 having frequency-adjusting capacitor patterns 50 to 55, inductor via-holes 61*a* to 61*e*, 62*a* to 62*e*, 63*a* to 63*e*, 64*a* to 64*e*, 65*a* to 65*e*, and 66*a* to 66*e*, capacitor patterns 70 to 75, coupling-adjusting capacitor patterns 76 to 79, the inductor patterns 84 and 85, and shield patterns 90*a*, 90*b*, 91*a* and 91*b*.

The insulator sheets 42 to 49 are produced preferably by kneading dielectric powder and magnetic powder with a binder to form sheets. The inductor via-holes 61*a* to 61*e*, 62*a* to 62*e*, 63*a* to 63*e*, 64*a* to 64*e*, 65*a* to 65*e*, and 66*a* to 66*e* are formed by filling conductive paste of Ag, Pd, Cu, Au, Ag Pd, etc. in openings that have been provided in the insulator sheets 43 to 47. The frequency-adjusting capacitor patterns 50 to 55, etc. are made of Ag, Pd, Cu, Au, Ag-Pd, etc., and are formed by, for example, printing.

The inductor via-holes 61*a* to 61*e*, 62*a* to 62*e*, 63*a* to 63*e* of the band-pass filter BPF1 are provided in substantially the left-hand region of the insulator sheets 43 to 47. The inductor via-holes 61*a* to 61*e* are connected in sequence in the laminating direction of the sheets 43 to 47 to define a columnar inductor L1. Similarly, the inductor via-holes 62*a* to 62*e*, and 63*a* to 63*e* are connected in sequence in the laminating direction of the sheets 43 to 47 to define columnar inductors L2 and L3, respectively. The inductors L1 to L3 have axes that extend substantially parallel to the stacking direction of the sheets 43 to 47.

When the length of the columnar inductors L1 to L3 defined by the inductor via-holes 61*a* to 61*e*, 62*a* to 62*e*, and 63*a* to 63*e* is approximately $\lambda/4$, where $\lambda$ is the wavelength corresponding to a desired resonant frequency, the LC resonators Q1 to Q3 function as $\lambda/4$ resonators. Of course, the length of the inductors L1 to L3 is not limited to about $\lambda/4$ and other lengths may be used.

The inductor via-hole 61*c* is connected to a lead pattern 81, and the lead pattern 81 is exposed at the left edge of the sheet 45. The inductor via-hole 63*c* is connected to the inductor pattern 84. The inductor pattern 84 defines an inductor Ls1 used for impedance matching. The inductor via-holes 61*d*, 62*d* and 63*d* are connected to the capacitor patterns 70, 71 and 72, respectively, provided on the left-hand region of the insulator sheet 46.

The frequency-adjusting capacitor patterns 50, 51 and 52 are provided on substantially the left-hand region of the insulator sheet 48 as viewed in the Figures to extend from the front edge to the rear edge of the sheet 48. The frequency-adjusting capacitor patterns 50, 51 and 52 face the shield pattern 90*b* through the sheet 48 to define capacitors C1, C2 and C3, respectively. One end of the inductor L1, that is, the via-hole 61*e*, is directly connected to the frequency-adjusting capacitor pattern 50; one end of the inductor L2, that is, the via-hole 62*e*, is directly connected to the frequency-adjusting capacitor pattern 51; one end of the inductor L3, that is, the via-hole 63*e*, is directly connected to the frequency-adjusting capacitor pattern 52.

The other end of the inductor L1, that is, the via-hole 61*a*, is directly connected to the shield pattern 90*a* on the insulator sheet 43. Also, the other end of the inductor L2, that is, the via-hole 62*a*, is directly connected to the shield pattern 90*a*, and the other end of the inductor L3, that is, the via-hole 63*a*, is directly connected to the shield pattern 90*a*.

The coupling-adjusting capacitor patterns 76 provided on the left-hand region of the insulator sheet 47 faces the capacitor patterns 50 and 51 across the sheet 47, and faces the capacitor patterns 70 and 71 across the sheet 46, defining a coupling capacitor Cs1. The coupling-adjusting capacitor pattern 77 faces the capacitor patterns 51 and 52 through the sheet 47, and also faces the capacitor patterns 71 and 72 through the sheet 46, defining a coupling capacitor Cs2.

The inductor L1 defined by the inductor via-holes 61*a* to 61*e* and the capacitor C1 formed by the frequency-adjusting capacitor pattern 50 and the shield pattern 90*b* then form a parallel LC resonant circuit, thus providing the first-stage LC resonator Q1 of the band-pass filter BPF1. The inductor L2 defined by the inductor via-holes 62*a* to 62*e* and the capacitor C2 defined by the frequency-adjusting capacitor pattern 51 and the shield pattern 90*b* form a parallel LC resonant circuit, thus providing the second-stage LC resonator Q2 of the band-pass filter BPF1. The inductor L3 defined by the inductor via-holes 63*a* to 63*e* and the capacitor C3 defined by the frequency-adjusting capacitor pattern 52 and the shield pattern 90*b* form a parallel LC resonant circuit, thus providing the third-stage LC resonator Q3 of the band-pass filter BPF1. The LC resonators Q1 to Q3 are electrically coupled via the coupling capacitors Cs1 and Cs2, whereby the three-stage band-pass filter BPF1 is provided.

The inductor via-holes 64*a* to 64*e*, 65*a* to 65*e*, and 66*a* to 66*e* of the band-pass filter BPF2 are formed in substantially the right-hand region of the insulator sheets 43 to 47. The inductor via-holes 64*a* to 64*e* are connected in sequence in the laminating direction of the sheets 43 to 47 to form a columnar inductor L4. Similarly, the inductor via-holes 65*a* to 65*e* and 66*a* to 66*e* are connected in sequence in the laminating direction of the sheets 43 to 47 to form columnar inductors L5 and LG, respectively. The inductors L4 to L6 have axes that extend substantially parallel to the laminating direction of the sheets 43 to 47.

When the length of the columnar inductors L4 to L6 defined by the inductor via-holes 64*a* to 64*e*, 65*a* to 65*e*, and 66*a* to 66*e* is approximately $\lambda/4$, where $\lambda$ is the wavelength corresponding to a desired resonant frequency, the LC resonators Q4 to Q6 function as $\lambda/4$ resonators. Of course, the length of the inductors L4 to L6 is not limited to approximately $\lambda/4$.

The inductor via-hole 64*c* is connected to the inductor pattern 85. The inductor pattern 85 defines an impedance matching inductor Ls2. The inductor pattern 85, as well as the inductor pattern 84, is connected to a lead pattern 83. The lead pattern 83 is exposed at an approximately central portion at the rear of the sheet 45. The inductor via-hole 66*c* is connected to a lead pattern 82, and the lead pattern 82 is exposed at the right edge of the sheet 45. The inductor via-holes 64*d*, 65*d* and 66*d* are connected to the capacitor patterns 73, 74 and 75, respectively, provided on the right-hand region of the insulator sheet 46 as viewed in the Figures.

The frequency-adjusting capacitor patterns 53, 54 and 55 are provided on substantially the right-hand region of the insulator sheet 48 to extend from the front to the rear of the sheet 48. The frequency-adjusting capacitor patterns 53, 54 and 55 face the shield pattern 91*b* across the sheet 48 to define capacitors C4, C5 and C6, respectively. The via-hole 64*e*, that is, an end of the inductor L4, is directly connected to the frequency-adjusting capacitor pattern 53. The via-hole 65*e*, that is, an end of the inductor L5, is directly connected to the frequency-adjusting capacitor pattern 54. The via-hole 66*e*, that is, an end of the inductor L6, is directly connected to the frequency-adjusting capacitor pattern 55.

The other end of the inductor L4, that is, the via-hole 64*a*, is directly connected to the shield pattern 91*a* on the insulator sheet 43. The other end of the inductor L5, that is, the via-hole 65*a*, is directly connected to the shield pattern 91*a*, and the other end of the inductor L6, that is, the via-hole 66*a*, is directly connected to the shield pattern 91*a*.

The coupling-adjusting capacitor pattern 78 provided on the right-hand region of the insulator sheet 47 faces the capacitor patterns 53 and 54 through the sheet 46, and also faces the capacitor patterns 73 and 74 through the sheet 47, defining a coupling capacitor Cs3. The coupling-adjusting capacitor pattern 79 faces the capacitor patterns 54 and 55 through the sheet 46, and also faces the capacitor patterns 74 and 75 through the sheet 47, defining a coupling capacitor Cs4.

The inductor L4 defined by the inductor via-holes 64*a* to 64*e*, together with the capacitor C4 defined by the frequency-adjusting capacitor pattern 53 and the shield pattern 91*b*, defines a parallel LC resonant circuit, thus providing the first-stage LC resonator Q4 of the band-pass filter BPF2. The inductor L5 defined by the inductor via-holes 65*a* to 65*e*, together with the capacitor C5 defined by the frequency-adjusting capacitor pattern 54 and the shield pattern 91*b*, defines a parallel LC resonant circuit, thus providing the second-stage LC resonator Q5 of the band-pass filter BPF2. The inductor L6 defined by the inductor via-holes 66*a* to 66*e*, together with the capacitor C6 defined by the frequency-adjusting capacitor pattern 55 and the shield pattern 91*b*, defines a parallel LC resonant circuit, thus providing the third-stage LC resonator Q6 of the band-pass filter BPF2. The LC resonators Q4 to Q6 are electrically coupled via the coupling capacitors Cs3 and Cs4, whereby the three-stage band-pass filter BPF2 is provided.

The thus constructed sheets 42 to 49 are laminated in a manner shown in FIG. 1, and are then integrally fired to define a laminate 100 shown in FIG. 2. The laminate 100 has a transmitter terminal electrode Tx and a receiver terminal electrode Rx provided on the left and right ends thereof, respectively. An antenna terminal electrode ANT and grounding terminal electrodes G1 and G3 are provided on the rear surface of the laminate 100, and grounding terminal electrodes G2 and G4 are provided on the front surface thereof.

The lead patterns 81, 82 and 83 are connected to the transmitter terminal electrode Tx, the receiver terminal electrode Rx, and the antenna terminal electrode ANT, respectively. An end of the shield pattern 90*a* and the associated end of the shield pattern 90*b* are connected to the grounding terminal electrode G1. The other end of the shield pattern 90*a* and the associated end of the shield pattern 90*b* are connected to the grounding terminal electrode G2. Likewise, an end of the shield pattern 91*a* and the associated end of the shield pattern 91*b* are connected to the grounding terminal electrode G3. The other end of the shield pattern 91*a* and the associated end of the shield pattern 91*b* are connected to the grounding electrode terminal G4.

FIG. 3 shows an electrical circuit equivalent to the laminated type duplexer 41 having the construction described heretofore.

The resonators Q1 to Q3 are electrically coupled to each other via the coupling capacitors Cs1 and Cs2, whereby the three-stage band-pass filter BPF1 is provided. The resonators Q4 to Q6 are electrically coupled to each other via the coupling capacitors Cs3 and Cs4, whereby the three-stage band-pass filter BPF2 is provided. One end of the band-pass filter BPF1 (resonator Q1) is connected to the transmitter terminal electrode Tx, and the other end thereof (resonator Q3) is connected to the antenna terminal electrode ANT through the impedance matching inductor Ls1. One end of the band-pass filter BPF2 (resonator Q6) is connected to the receiver terminal electrode Rx, and the other end thereof (resonator Q4) is connected to the antenna terminal electrode ANT through the impedance matching inductor Ls2.

In operation, a transmission signal is input from a transmitter circuit system (not shown) into the transmitter terminal electrode Tx, while a reception signal is input from the antenna terminal electrode ANT. In turn, the laminated type duplexer 41 outputs the transmission signal from the antenna terminal electrode ANT through the band-pass filter BPF1. The duplexer 41 also outputs the reception signal from the receiver terminal electrode Rx to a receiver circuit system (not shown) though the band-pass filter BPF2.

The transmission frequency of the band-pass filter BPF1 depends upon the respective resonant frequencies of the resonator Q1 defined by the inductor L1 and the capacitor C1, the resonator Q2 defined by the inductor L2 and the capacitor C2, and the resonator Q3 defined by the inductor L3 and the capacitor C3. The transmission frequency of the band-pass filter BPF1 is adjusted by, for example, changing the areas of the capacitor patterns 50, 51, and 52 of the capacitors C1, C2, and C3 to change the electrostatic capacitance of the capacitors C1, C2, and C3.

The transmission frequency of the band-pass filter BPF2 depends upon the respective resonant frequencies of the resonator Q4 defined by the inductor L4 and the capacitor C4, the resonator Q5 defined by the inductor L5 and the capacitor C5, and the resonator Q6 defined by the inductor L6 and the capacitor C6. The transmission frequency of the band-pass filter BPF2 is adjusted by, for example, changing the areas of the capacitor patterns 53, 54, and 55 of the capacitors C4, C5, and C6.

In the laminated type duplexer 41 of various preferred embodiments of the present invention, improvements in the Q factors of the columnar inductors L1 to L6 are achieved when the cross-sectional areas of these inductors are increased to reduce resistances. This is achieved by using an increased number of via-holes 61*a* to 61*e*, 62*a* to 62*e*, 63*a* to 63*e*, 64*a* to 64*e*, 65*a* to 65*e*, and 66*a* to 66*e* connected in sequence, or otherwise increasing the cross-sectional areas of the individual via-holes. Accordingly, it is not necessary to increase the thickness or width of inductor patterns as is conventionally done, to overcome problems with delamination during the firing or with large components.

Furthermore, since the inductors L1 to L6 are substantially perpendicular to the patterns 50 to 55, 70 to 75, and 90*a* to 91*b*, any magnetic flux $\phi$ generated by electric currents flowing through the inductors L1 to L6 does not pass through these patterns, so that no eddy current occurs in these patterns. As a result, the inductors L1 to L6 having very high Q factors are obtained and eddy current loss is greatly reduced.

The laminated type duplexer according to the present invention is not limited on the illustrated preferred embodiments, and a variety of modifications may be made without departing from the spirit and scope of the invention. For example, it is not necessary for the inductor via-holes to be linear, and meandering or spiral via-holes may be used instead. The shield patterns may also be provided only in the upper or lower portion of the laminate. A duplexer having one of the impedance matching inductors Ls1 and Ls2 is also possible.

The duplexer in accordance with the present invention is not limited to a duplexer having a combination of band-pass filters, and may include a branching filter such as a duplexer or triplexer including low-pass filters, high-pass filters and trap circuits, and a combination of these different kinds of circuits. Furthermore, it is not essential that all of the inductors of resonators in filters be defined by via-holes, and a duplexer in which only selected inductors are formed by via-holes falls within the scope of the present invention.

In the illustrated preferred embodiments, the insulator sheets each having the conductor patterns and via-holes provided thereon are laminated and then integrally fired. This, however, is only illustrative and the insulator sheets may be fired in advance of the firing. The resonators and the other components may be produced by a process as will be described below. That is, an insulator layer is formed of a paste of insulating materials by using a technique such as printing. Then, a paste of conductive materials is applied to a surface of the insulator layer to define conductor patterns or via-holes. The paste of insulating materials is applied thereto and overlaid thereon to define an insulator layer. Sequential layering operations in this manner make it possible to provide a duplexer having a laminated structure.

While the invention has been particularly shown and described with reference to preferred embodiments, it will be understood by those skilled in the art that the foregoing and other changes in form and details can be made without departing from the spirit and scope of the invention.

What is claimed is:

1. A laminated type duplexer comprising:

a plurality of insulator layers stacked on each other to define a laminate;

a plurality of filters embedded in the laminate, each of said filters having an inductor and a capacitor, each of said filters having a parallel LC resonant circuit and being disposed such that the inductors are adjacent to and substantially parallel with one another;

wherein each of the inductors is defined by via-holes connected in sequence in the direction of stacking of the insulator layers, and a matching inductor pattern is arranged such that at least two adjacent filters of said plurality of filters are electrically connected to each other through the matching inductor pattern, wherein each of the inductors extends in an axial direction that is substantially perpendicular to a plane in which the matching inductor pattern is disposed.

2. A laminated type duplexer according to claim 1, wherein the impedance matching pattern includes an inductor pattern.

3. A laminated type duplexer according to claim 1, wherein said insulator sheets include frequency-adjusting capacitor patterns, shield patterns, inductor via-holes, capacitor patterns, and coupling-adjusting capacitor patterns.

4. A laminated type duplexer according to claim 1, wherein said insulator sheets are made of dielectric material and magnetic powder.

5. A laminated type duplexer according to claim 1, wherein said insulator sheets include via-holes filled with conductive paste.

6. A laminated type duplexer according to claim 1, further including frequency-adjusting capacitor patterns.

7. A laminated type duplexer according to claim 1, wherein the inductor via-holes are connected in sequence in the laminating direction to define a columnar inductor.

8. A laminated type duplexer according to claim 1, wherein the inductors are defined by the frequency-adjusting capacitor pattern and the shield pattern defining a parallel LC resonant circuit.

9. A laminated type duplexer according to claim 1, wherein the inductors have axes that extend substantially parallel to the stacking direction of the sheets.

10. A laminated type duplexer according to claim 1, wherein the length of the inductors defined by the inductor via-holes is approximately $\lambda/4$, where $\lambda$ is the wavelength corresponding to a desired resonant frequency.

11. A laminated type duplexer according to claim 1, wherein the laminate includes a transmitter terminal electrode and a receiver terminal electrode provided thereon.

12. A laminated type duplexer according to claim 1, wherein at least one of the inductors and least one of the capacitors and a shield plate define a parallel LC resonant circuit that is a first stage resonator of a band pass filter.

13. A laminated type duplexer according to claim 1, wherein at least one of the inductors and least one of the capacitors and a shield plate define a parallel LC resonant circuit that is a second stage resonator of a band pass filter.

14. A laminated type duplexer according to claim 1, wherein at least one of the inductors and least one of the capacitors and a shield plate define a parallel LC resonant circuit that is a third stage resonator of a band pass filter.

15. A laminated type duplexer according to claim 1, wherein the laminate includes an antenna terminal electrode and grounding terminal electrodes provided thereon.

16. A laminated type duplexer according to claim 1, wherein the plurality of filters are arranged to define a three-stage band-pass filter BPF1.

17. A laminated type duplexer according to claim 1, further comprising a duplexer including a first three-stage band-pass filter having parallel LC resonators, and a second three-stage band-pass filter having parallel LC resonators, wherein the first and second band-pass filters are connected through inductor patterns.

18. A laminated type duplexer according to claim 17, wherein the LC resonators are constructed to define $\lambda/4$ resonators, where $\lambda$ is the wavelength corresponding to a desired resonant frequency.

19. A laminated type duplexer according to claim 1, wherein a plurality of the inductors and capacitors and a plurality of shield plates are arranged to define LC resonators.

20. A laminated type duplexer according to claim 19, wherein the LC resonators are electrically coupled to define a three-stage band-pass filter.

* * * * *